US009858793B2

(12) United States Patent
Hawsah

(10) Patent No.: US 9,858,793 B2
(45) Date of Patent: Jan. 2, 2018

(54) SWIMMING AID TO PREVENT DROWNING

(71) Applicant: Asma Saleh Hawsah, Medina (SA)

(72) Inventor: Asma Saleh Hawsah, Medina (SA)

( * ) Notice: Subject to any disclaimer, the term of this patent is extended or adjusted under 35 U.S.C. 154(b) by 326 days.

(21) Appl. No.: 14/693,937

(22) Filed: Apr. 23, 2015

(65) Prior Publication Data

US 2016/0314675 A1 Oct. 27, 2016

(51) Int. Cl.
*G08B 21/08* (2006.01)

(52) U.S. Cl.
CPC ..... *G08B 21/088* (2013.01)

(58) Field of Classification Search
CPC .... G08B 21/08; G08B 21/082; G08B 21/084; G08B 21/086; G08B 21/088; A61B 5/68; A61B 5/6801; A61B 5/681; A63B 2220/00; A63B 2220/10; A63B 2220/12; A63B 2220/13; A63B 2220/14; A63B 2220/17; A63B 2220/80; A63B 31/00; A63B 31/02; A63B 31/12; A63B 33/00; B63C 9/0005; E04H 4/14; E04H 4/148
USPC ..... 340/573.1, 573.6
See application file for complete search history.

(56) References Cited

U.S. PATENT DOCUMENTS

| | | | | |
|---|---|---|---|---|
| 8,613,637 | B2 | 12/2013 | Puls et al. | |
| 2008/0266118 | A1* | 10/2008 | Pierson | A61B 5/0205 340/573.6 |
| 2009/0309739 | A1 | 12/2009 | Ezer et al. | |
| 2010/0117838 | A1 | 5/2010 | Humbard | |
| 2011/0241887 | A1* | 10/2011 | McKinney | G08B 21/088 340/573.6 |

FOREIGN PATENT DOCUMENTS

| | | |
|---|---|---|
| KR | 10-2010-0004644 | 1/2010 |

OTHER PUBLICATIONS

Pulsivision, "The vital aqua protect (V.A.P.) for fun and safety in the water", http://www.pulsivision.de/media/vap.pdf.
Wu, et al., "A Wearable Early Monitoring and Alarming Device for Swimming Pool Drowning Incidents", Journal of Computational Information Systems 9:21, Nov. 1, 2013, pp. 8619-8627, http://www.jofcis.com/publishedpapers/2013_9_21_8619_8627.pdf.
Seal Innovation, Inc., "The SEAL : Wearable Swim Monitoring and Drowning Detection System", 2013, https://www.indiegogo.com/projects/the-seal-wearable-swim-monitoring-and-drowning-detection-system.

* cited by examiner

*Primary Examiner* — Brian Wilson
(74) *Attorney, Agent, or Firm* — Oblon, McClelland, Maier & Neustadt, L.L.P.

(57) ABSTRACT

A system for drowning prevention in a swimming pool including a wearable swimming aide having a plurality of wireless sensors including as an underwater depth transmitter, a heart rate sensor, a motion sensor and a blood oxygen sensor. Further the system includes an underwater array of sensors and an overhead array of sensors configured to receive signal from the underwater depth transmitter. A drowning prevention controller configured to receive signal from the wearable swimming aid, the underwater array of sensors, and the overhead array of sensors. The drowning prevention controller configured to activate an alarm system that includes an underwater array of light and an array of underwater bubble generator. Further drowning prevention controller is a circuitry implementing a method that includes determination of drowning event, the location and activation of the alarm system.

9 Claims, 9 Drawing Sheets

SWIMMING AID TO PREVENT DROWNING

BACKGROUND

Grant of Non-Exclusive Right

This application was prepared with financial support from the Saudi Arabian Cultural Mission, and in consideration therefore the present inventor(s) has granted The Kingdom of Saudi Arabia a non-exclusive right to practice the present invention.

Field of the Disclosure

This application relates generally to safety and monitoring system for swimmers. More particularly the present disclosure relates to improvements in safety and monitoring system and method for a person in pre-drowning to initial stages of drowning stages.

Description of the Related Art

Accidental drowning during swimming is a leading cause of death all over the world. Each year thousands of people die due to drowning. Drowning occurs among both experienced adult swimmers and non-experienced swimmers such as children. Drowning occurs when a swimmer is submerged under water gasping for air thus swallowing of large quantities of water in the process. The amount of time a person can hold breathe under water varies from person to person. Lack of air causes lack of oxygen to the body which may eventually lead to death. A swimmer may be submerged under due to various reasons like non-supervision, fatigue, inexperience, sudden medical condition (like seizure, heart attack, hypoglycaemia-low blood sugar), and hypothermia.

Swimming is of the most favorable sports and recreational activities among all age groups and performed throughout the year. Swimming pools is the most common water body and they typically employ life guards for swimmers safety. Life guards monitor swimmers and save them from drowning. However, even with life guards drowning occurs due to large number of people in the swimming pools. Some swimming pools employ additional safety measure such as underwater cameras to detect people under water. However, even with additional safety measures drowning events occur often.

SUMMARY

According to an embodiment of the present disclosure, there is provided a system for drowning prevention in a swimming pool. The system includes a wearable swimming aide with a plurality of wireless sensors including an underwater depth transmitter, a heart rate sensor, a motion sensor and a blood oxygen sensor. The system further includes an underwater array of sensors and an overhead array of sensors, fixed on a panel above the water in the swimming pool, configured to receive signal from the underwater depth transmitter. The system also includes a drowning prevention controller configured to receive signal from the underwater depth transmitter, the heart rate sensor and the blood oxygen sensor of the wearable swimming aide, the underwater array of sensors, and the overhead array of sensors. The drowning prevention controller configured to activate an alarm system including an underwater array of light and an array of underwater bubble generator in response to the drowning prevention controller determining a drowning event may be occurring for a wearer of the wearable swimming aide.

Further, according to an embodiment of the present disclosure, there is provided a method for drowning prevention of a swimmer wearing a swimming aide. The method includes performing a plurality of non-swimming activities while wearing a swimming aide, recording a first set of sensor data transmitted from the swimming aide, a non-swimming activity time, and a non-swimming activity distance, performing a swimming activity while wearing the swimming aide, recording a second set of sensor data transmitted from the swimming aide, comparing the first set of sensor data with the second set of sensor data, determining a maximum swimming distance and a maximum swimming time, setting a drowning threshold limit, triggering the alarm system when the drowning threshold limit is reached, triggering the alarm system when the maximum swimming distance is reached, triggering the alarm system when the maximum swimming time is reached, determining a location of the swimmer, and rescuing the swimmer.

The maximum swimming distance and the maximum swimming time is determined based on a correlation established between the first set of sensor data with the second set of sensor data.

Further, according to an embodiment of the present disclosure, there is provided a non-transitory computer-readable medium which stores a program which, when executed by a computer, causes the computer to perform the method for drowning prevention, as discussed above.

The forgoing general description of the illustrative implementations and the following detailed description thereof are merely exemplary aspects of the teachings of this disclosure, and are not restrictive.

DETAILED DESCRIPTION

Figure 1:
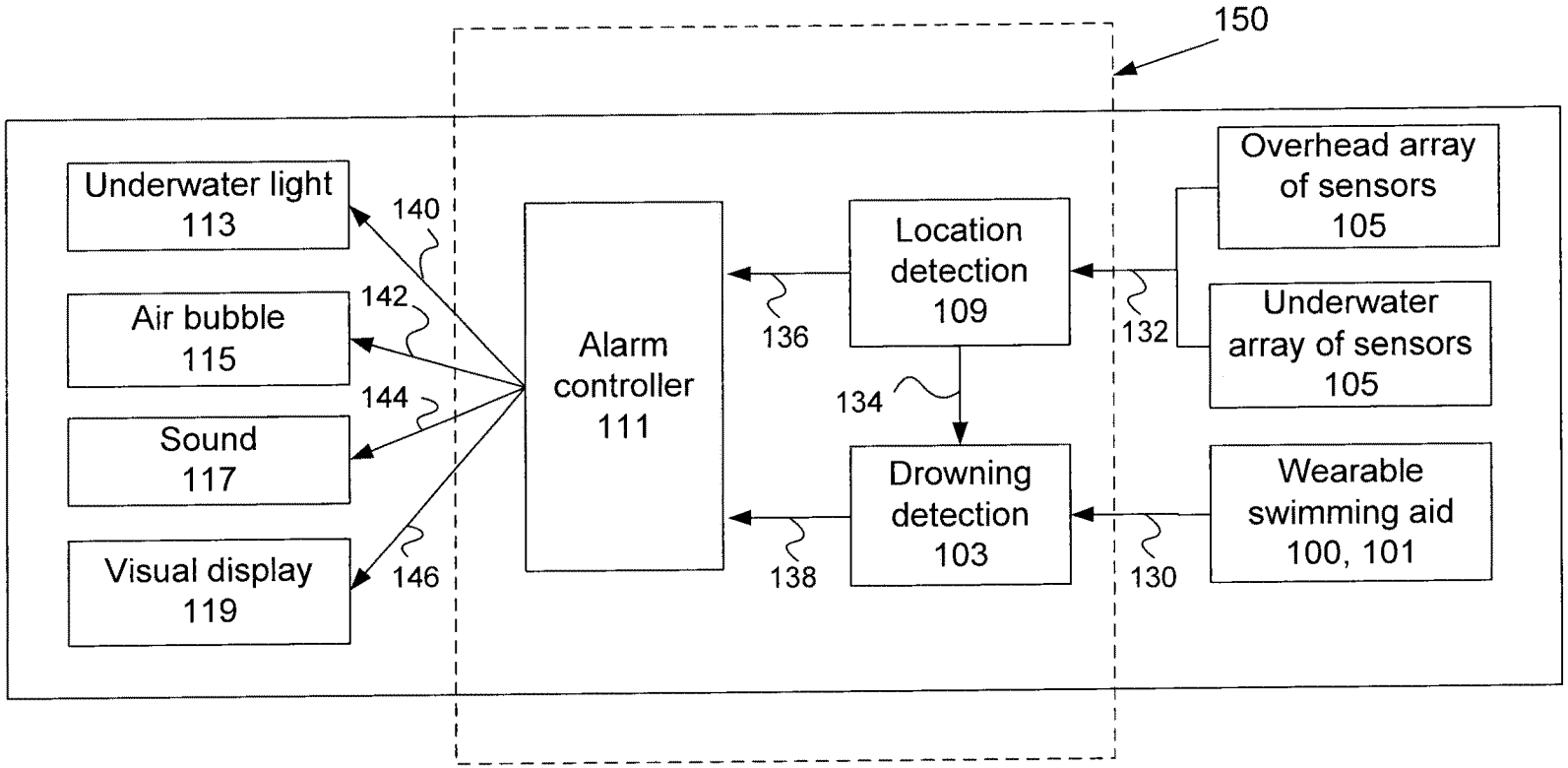
FIG. 1 is block diagram of a system for preventing drowning according to an exemplary embodiment of the present disclosure.

In the drawings, like reference numerals designate identical or corresponding parts throughout the several views. Further, as used herein, the words "a", "an" and the like generally carry a meaning of "one or more", unless stated otherwise. The drawings are generally drawn to scale unless specified otherwise or illustrating schematic structures or flowcharts.

Furthermore, the terms "approximately," "proximate," "minor," and similar terms generally refer to ranges that include the identified value within a margin of 20%, 10% or preferably 5% in certain embodiments, and any values therebetween.

FIG. 1 is block diagram of a drowning prevention system according to an exemplary embodiment of the present disclosure. The drowning prevention system includes a wearable swimming aide 101, an array of underwater sensors 105, an array of overhead sensors 107, an array of underwater light 113, an array of underwater bubble generator 115, a monitoring station that includes a visual display 119 and a sound alarm 117, and a drowning detection controller 103 and location detection controller 109, and an alarm controller 111 that activates different alarms.

The wearable swimming aide 101 provides inputs to the drowning detection controller 103 through a wireless communication link 130. The inputs such as heart rate, blood oxygen level, number of swimming strokes etc. are processed in the drowning detection controller 103, which implements an algorithm to determine if a swimmer is drowning. The drowning detection controller 103 further communicates with the alarm controller 111 through a communication channel 138.

The underwater array of sensors 105 and the overhead array of sensors 107 provide inputs to the location detection controller 109 via a communication channel 132. The location detection controller 109 implements an algorithm to determine the exact location of the swimmer who is drowning. The location controller 109 further communicates with the alarm controller 111 through communication channel 136 and may also communicate with the drowning detection controller 103 through a communication channel 134, which process the inputs to determine if a swimmer is drowning. The underwater sensors are receivers that are compatible with underwater transmitters such as acoustic, laser, IR, optical sensing devices or any combination thereof Underwater sensors typically have low operating frequency, low data transmission capability and can transmit and receive signals within short distances ranging from few centimeters to several hundred meters. Depending on the depth of the pool appropriate sensors must be selected. Also, in order to increase the probability of receiving the signal transmitted from the swimming aide, especially when a swimmer is closer to the water surface, overhead sensor arrays are provided.

The alarm controller 111 activates different alarms based on the inputs received from the location detection controller 109 and the drowning detection controller 103. The controller can activate different types of alarms. For example, a sound alarm 117 and a visual display alarm 119 can be activated, so that a rescuer like a lifeguard, swimmer parents or friends may be alerted of the drowning situation. Further, an underwater light and a stream of air bubble may be activated based on the location of the swimmer. The advantage being the drowning location can be identified quickly and the rescue operation will be faster. Drowning process may lead to swimmer's death in minutes; hence a faster drowning and location identification can lead to higher survival probability of the swimmer.

Figure 2A:
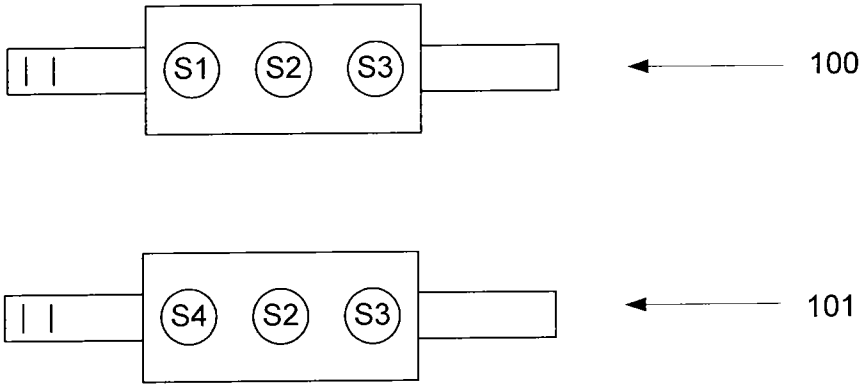
FIG. 2A illustrates a set of sensors attached to wearable device according to an exemplary embodiment of present disclosure.

FIG. 2A illustrates the swimming aides 100 and 101 for an arm and leg respectively. The swimming aides 100 and 101 include a plurality of sensors. For example, physiological sensors S1 and S6 to measure the heart rate and blood oxygen level, motion sensors S3 and S8 to measure the number of arm strokes and leg strokes, and depth transmitters S5 and S10 to transmit signals to the underwater array of receivers 105 and the array of overhead receivers 107. The measurements from sensors S1, S3, S5, S6, S8, and S10 can be converted into measures indicative of drowning. For example, a low blood oxygen and high pulse rate may be indicative of a person drowning. The number of arm strokes or leg strokes can be converted into swimming distance that can be further compared with a predetermined maximum swimming distance. The maximum swimming distance can be determined from historic swimming data, or estimated by recording physiological data for non-swimming activities such as walking, running etc.

Figure 2B:
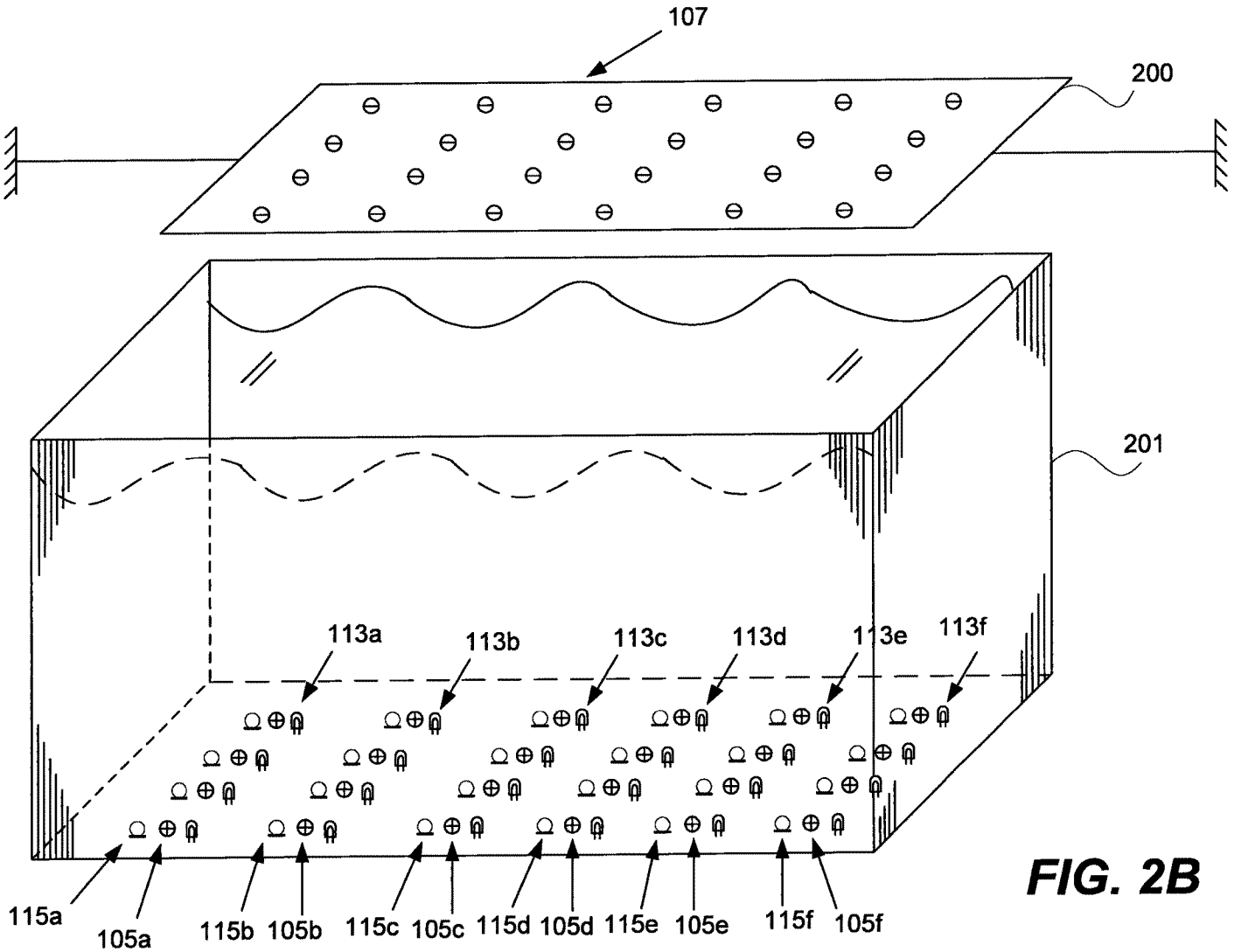
FIG. 2B illustrates an array of underwater sensors and an array of overhead sensors according to an embodiment of present disclosure.

FIG. 2B illustrates an exemplary configuration of the underwater array of components and the overhead array of sensors in a swimming pool. The swimming pool 201 is fitted with a plurality of underwater components including an array of underwater sensor 105*a*-105*f* (also collectively referred as 105), underwater array of light 113*a*-113*f* (also collectively referred as 113) and underwater array of bubble generator 115*a*-115*f* (also collectively referred as 115).

The array of underwater sensors 105 can be fitted into the floor of the swimming pool or on a detachable platform. Further, the detachable platform may be raised or lower to different pool depths. According to the present disclosure, the overhead array of sensors 107 is fitted on a fitted platform 200. Alternately, the overhead array of sensors 107 may be fitted on the lane dividers available in the swimming pool. The underwater array of sensors 105 and overhead array of sensors 107 have equal number of sensors. Each sensor on the underwater array of sensors 105 is aligned with a similarly placed sensor on the overhead array of sensors 107.

The array of underwater sensors 105 and overhead sensors 107 communicate wirelessly with the depth transmitters S5 and S10 fitted on the swimming aide. And the signals from the array of underwater sensors 105 and overhead sensors 107 are further used to determine a swimmer's location in the pool.

The array of light includes a set of light bulbs 113 arranged next to the underwater array of sensors 105. A particular light bulb can be activities by the alarm controller 111 (not shown). Similarly the array of bubble generator 115 includes a set of bubble generators 115 arranged next to the underwater array of sensors 105. A particular bubble generator can be activities by the alarm controller 111 (not shown). The activation of a particular light bulb and a particular bubble generator is based on the location signals obtained from depth transmitters S5 and S10 (see FIG. 2A) sent to the underwater and overhead array of sensors 105 and 107 respectively. Different types of location identifier provide diversity and higher factor of safety, so that if one of them is non-functional the other type of location identifier may be used. At least one location identifier should be installed in the swimming pool. Further, the location identifiers can be fitted into the floor of the swimming pool or on a detachable platform. Further, the detachable platform may be raised or lower to different pool depths. The installation of location identifiers are not limited to the above set of light arrays or bubble generator.

Figure 3:
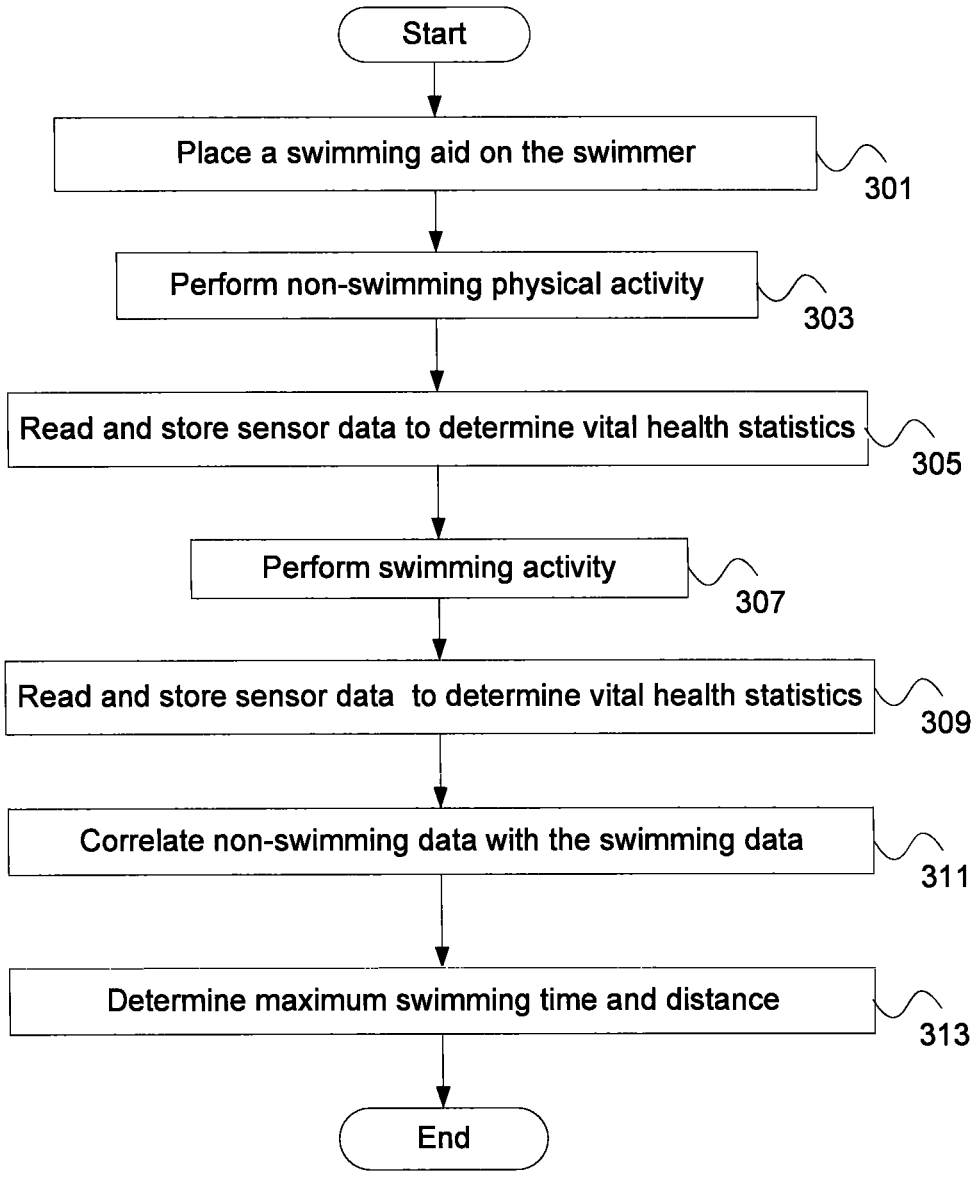
FIG. 3 is a flowchart for establishing non-swimming activity and swimming activity correlation according to an exemplary embodiment of present disclosure.
Figure 4:
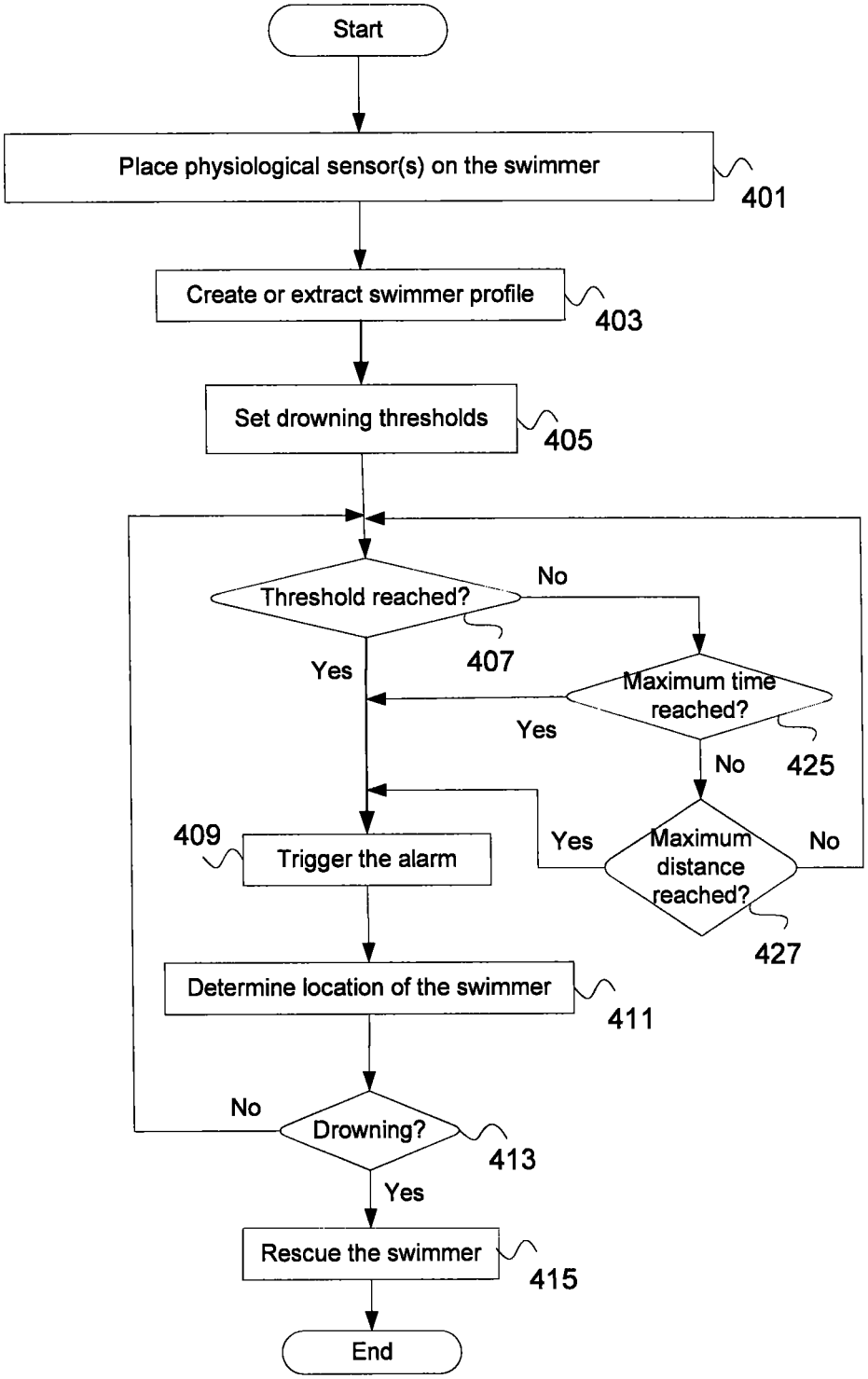
FIG. 4 is a flowchart for drowning detection process according to an exemplary embodiment of present disclosure.

FIGS. 3 and 4 are the flow chart for drowning detection implemented in the drowning detection controller 103. FIG. 3A a data collection process performed when a swimmer arrives at the swimming pool. The data collection includes recording vital statistics such as heart rate, blood oxygen level, amount of activity, or type of activity. Monitoring blood oxygen level is important to prevent death from drowning. During the physical activity energy is spent and blood oxygen level declines as the oxygen is consumed during an activity. It is possible to stop running and catch your breath to increase the oxygen level again. However during the swimming activity it may not always be feasible to stop to breath, for instance during drowning situation. Typical oxygen saturation level must be greater than 95%; however if the oxygen level falls below 90% it could be dangerous and may cause breathing difficulties, or lung diseases. There are many reasons why different people will normally have different blood oxygen levels and the differences support a wide range of acceptable blood oxygen levels. For example, blood oxygen level may vary based on the person's fitness level, health issues, region the person lives or trains etc.

In step 301, wearable swimming aides 100 and 101 are placed on an arm and a leg of a swimmer. On the arm, it can be placed on the wrist, biceps, or forearms of either hand; on the leg, it may be placed on the thigh, calf or ankle of either leg. Then, in step 303, the swimmer performs non-swimming activities such as running, walking, biking etc. In step 305, the sensors on the swimming aides 100 and 101 measure the vital statistics of the swimmer and are recorded in a database. Table 1 illustrates a sample database of the vital statistics collected.

TABLE 1

Sample database indicating sample values for different activities.
Age: 25
Swimming level: Intermediate
Lap number: 1

| Characteristics | Running | Biking | Swimming | Threshold |
|---|---|---|---|---|
| Pulse rate (beats/min) | 150 | 124 | 130 | 155 |
| Blood oxygen level (%) | 93.5% | 95% | 92% | 90% |
| Lap Distance (meters) | 1000 | 1000 | 300 | 500 |
| Lap Time (min) | 8 | 5 | 10 | 12 |

Then, in step 307, the swimmer performs swimming activities such as flutter kicks, catch and pull arm strokes, back arm stroke, paddling, treading, breast stroke etc. In step 309, the sensors on the swimming aides 100 and 101 measure the vital statistics of the swimmer and are recorded in a database such as Table 1. The database may be updated based on the swimmer's experience and frequently used swimming styles such as freestyle, breaststroke, butterfly etc.

In step 311, based on the data collected such as in table 1, a correlation between the swimming activity and non-swimming activity may be established. For example, the equations 1-4 establish the relationship between the heart rate, blood oxygen level, distance, and time. In step 313, the equations 1-4 are further used to estimate the maximum swimming distance and the maximum swimming time for a particular swimmer.

$$\mathrm{HRS}=a1*\mathrm{HRR}+b1*\mathrm{HRW} \quad (1)$$

$$\mathrm{BOLS}=a2*\mathrm{BOLR}+b2*\mathrm{BOLW} \text{ such that } b2<a2 \quad (2)$$

$$\mathrm{DistS}=a3*\mathrm{DistR}+b4*\mathrm{DistW} \quad (3)$$

$$\mathrm{TimeS}=a4*\mathrm{TimeR}+b4*\mathrm{TimeW} \quad (4)$$

$$\mathrm{Ma}\widehat{xDi}\,\mathrm{stS}=f(\mathrm{HRS},\mathrm{BOLS},\mathrm{DistS}) \quad (5)$$

$$\mathrm{Ma}\widehat{xTim}\,\mathrm{eS}=g(\mathrm{HRS},\mathrm{BOLS},\mathrm{TimeS}) \quad (6)$$

Where, a1, a2, a3, a4, b1, b2, b3, and b4 are coefficients of the model that can be determined from data fitting algorithms. HRR is a pulse rate, BOLR is a blood oxygen level, DistR is a distance, and TimeR is a time collected during the running activity. HRW is a pulse rate, BOLW is a blood oxygen level, DistW is a distance, and TimeW is a time collected during the walking activity. HRS is an estimated pulse rate, BOLS is an estimated blood oxygen level, DistS is an estimated distance, and TimeS is an estimated time for the running activity. Further, Ma $\widehat{xDi}$ stS is an estimated maximum swimming distance and Ma $\widehat{xTim}$ eS is an estimated maximum swimming time. The function f(.) and g(.) are the functions used to estimate the maximum swimming distance and the maximum swimming time.

Equation 1 is an example linear statistical model to correlate the heart rate during the swimming activity with the heart rate observed during the running and walking activity. The coefficients a1 and b1 are obtained from performed the statistical analysis such as Analysis of variance (ANOVA). The coefficients a1 and b1 are obtained from the ANOVA and will be specific to a particular swimmer.

Equation 2 is an example linear statistical model to correlate the blood oxygen level during the swimming activity with the blood oxygen level observed during the running and walking activity. The coefficients a2 and b2 are obtained from performed the statistical analysis such as Analysis of variance (ANOVA). The coefficients a2 and b2 are obtained from the ANOVA and will be specific to a particular swimmer. Since running more intense compared to walking, the value of b2 is expected to be larger than a2, thus indicating a higher oxygen required during running.

Equation 3 is an example linear statistical model to correlate the distance of swimming with the distance of the running and walking activity. The coefficients a3 and b3 are obtained from performed the statistical analysis such as Analysis of variance (ANOVA). The coefficients a3 and b3 are obtained from the ANOVA and will be specific to a particular swimmer.

Equation 4 is an example linear statistical model to correlate the time of swimming activity with the time of the running and walking activity. The coefficients a4 and b4 are obtained from performed the statistical analysis such as Analysis of variance (ANOVA). The coefficients a4 and b4 are obtained from the ANOVA and will be specific to a particular swimmer.

Equation 5 estimates a maximum distance a swimmer should cover based on the estimated swimming activity data obtained from equations 1-4 and stored in table 1. For example, a maximum swimming distance, Ma $\widehat{xDi}$ stS, may be calculated by simultaneously considering the maximum heart rate, max(HRS) and minimum blood oxygen level, max(BOLS), and the corresponding distances. If the maximum heart rate of 210 bpm was estimated for a swimming distance of 300 meters, then the estimated maximum distance is set to 300 meters (Ma $\widehat{xDi}$ stS=300 m). Hence, even if the swimmer is not actually drowning, the swimmer should be closely monitored after the maximum swimming distance is reached. Similarly, if the minimum oxygen level of 92% was estimated for a swimming distance of 500 meters (or any other unitary system), then the maximum swimming distance is set to 300 meters (Ma $\widehat{xDi}$ stS=300 m). Further, if the minimum oxygen level of 92% was estimated for a swimming distance of 200 meters (or any other unitary system), then the maximum swimming distance is set to 200 meters (Ma $\widehat{xDi}$ stS=200 m). Note that the maximum swimming distance set is the lowest maximum distance corresponding to the maximum heart rate and the minimum blood oxygen level.

Similarly, equation 6 estimates a maximum time a swimmer should cover based on the estimated swimming activity data obtained from equations 1-4 and stored in table 1. For example, a maximum swimming time, $\widetilde{MaxTim}eS$, may be calculated by simultaneously considering the maximum heart rate, max(HRS) and minimum blood oxygen level, max(BOLS), and the corresponding times. If the maximum heart rate of 210 bpm was estimated for a swimming time of 30 minutes, then the estimated maximum time is set to 30 minutes ($\widetilde{MaxTim}eS$=30 min). Hence, even if the swimmer is not actually drowning, the swimmer should be closely monitored after the maximum swimming time is reached. Similarly, if the minimum oxygen level of 92% was estimated for a swimming time of 50 minutes (or any other unitary system), then the maximum swimming time is set to 30 minutes ($\widetilde{MaxTim}eS$=30 min). Further, if the minimum oxygen level of 92% was estimated for a swimming time of 200 meters (or any other unitary system), then the maximum swimming time is set to 20 minutes ($\widetilde{MaxTim}eS$=20 min). Note that the maximum swimming time set is the lowest maximum time corresponding to the maximum heart rate and the minimum blood oxygen level.

Equations 1-6 are not limited to the running and walking activities. A person with ordinary skills can be further modified the equation to include other activities like biking. Further, the discussion related to equations 1-6 is not limited to international standard (SI) unitary system such as referring to units meters, and minutes. Other unitary system such as foot-pound-second (FPS) or US system may be used.

If the swimming activity data is not available or cannot be collected for a new swimmer, a beginner level swimming data available in the databases may be selected. The data selection is based on matching the non-swimming activity data collected for the new swimmer with historic dataset. Further, the matching historic dataset can be used to estimate the maximum swimming distance and the maximum swimming time for the new swimmer. If no data is found the new swimmer must be monitored more frequently.

FIG. 4 is the flow chart for determining drowning and rescue operation. In step 401, the swimming aides 100 and 101 are attached to the swimmer's arm and leg respectively. In step 403, a swimmer profile is created and personal information is entered as per table 1. For a returning swimmer, the stored profile is extracted. In step 405, drowning thresholds such as maximum or minimum heart rates and blood oxygen levels are set. The threshold levels may vary based on different factors such as age, fitness level, swimming experience, medical conditions etc. For example, for a highly fit person a maximum heart rate of 210 bpm or a minimum blood oxygen level of 90% may be set, while for a non-fit person a maximum heart rate of 160 bpm and a minimum blood oxygen level of 92% may be set. Also a watch dog timer is activated as soon as the swimmer enters the water.

In step 407, a determination of whether the threshold levels for drowning are reached is made based on the sensor data from the swimming aide 100 and 101. If the drowning threshold is reached, an alarm is triggered, in step 409. The alarm may be visual on a monitor screen or localized audio signal.

In step 411, the location of the swimmer is determined. The location of the swimmer is determined using the depth sensors S3. The depth sensors S3 communicate with underwater array of sensors 105 and the overhead array of sensors ##, which can be used to determine the location of the swimmer. Once the location is determined, the life guard can check if the swimmer is actually drowning, in step 413. Alternately, drowning may be detected automatically, if the swimmer is in a particular location more than certain amount of time indicating non-movement. For example, by plotting a bar graph of location, obtained from the underwater sensor array and the overhead sensor array data, against time for last 2 minutes. If the height of the bar is more than 1 minute, it can indicate drowning scenario.

If the swimmer is not drowning, the alarm is turned off and the process continues checking for threshold. To prevent the alarm from activating again, the alarm may be put in snooze mode and the lifeguard can keep monitoring the swimmer more closely.

If the swimmer is drowning, the rescue operation begins, in step 415. The rescue operation involves activating the underwater light 113 and the bubble generator 115 in the vicinity of the drowning location determined.

Referring back to step 407, if the threshold is not reached then in step 425 a determination of whether the maximum swimming time for a particular swimmer has reached or not. If the maximum swimming time has reached, the process leads to step 409 where an alarm is trigger to alert lifeguard and the process continues as discusses earlier.

If the maximum swimming time is not reached in step 425, the process leads to a maximum swimming distance check, in step 427. If the maximum distance has reached then process leads to step 409 where an alarm is trigger to alert lifeguard and the process continues as discusses earlier. If the maximum distance is not reached the process leads back to step 407.

Figure 5:
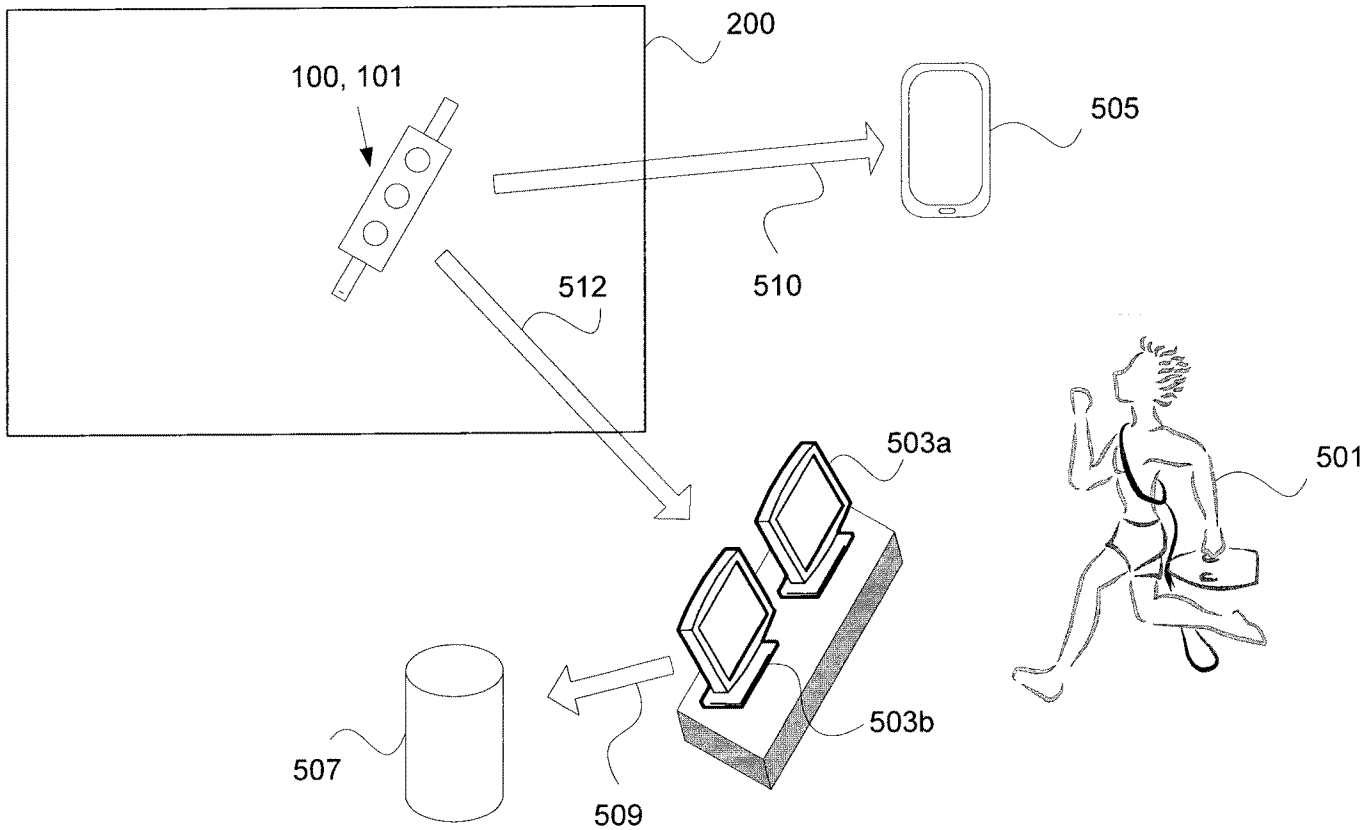
FIG. 5 is an example implementation of the drowning prevention system in a swimming pool according to an embodiment of present disclosure.

FIG. 5 illustrates an implementation of the drowning prevention system. The swimming aides 100 and 101 transmit swimming activity data such as heart rate, depth, blood oxygen level, and number of strokes to monitoring stations 503*a* and 503*b* via a wireless communication channel 512. The monitoring stations 503*a* and 503*b* process the swimming data to determine drowning, location of the swimmer and activation of the alarms. A lifeguard 501 located at the monitoring stations 503*a* and 503*b* monitors all the swimmers in the swimming pool 200. If drowning situation is trigger, the lifeguard 501 runs to the drowning location and rescues the swimmer. The swimming activity data and the processed data can be recorded into a database 507 via a communication channel 509, which can be wired or wireless. The data stored in 507 can be used for future drowning prevention analysis when the swimmer visits the swimming pool again. The swimming activity data can also be transmitted to a portable wireless device 505 such as a smart phone or a tablet. The wireless device 505 can also process the swimming data to determine drowning, location of the swimmer and activation of the alarms.

Figure 6A:
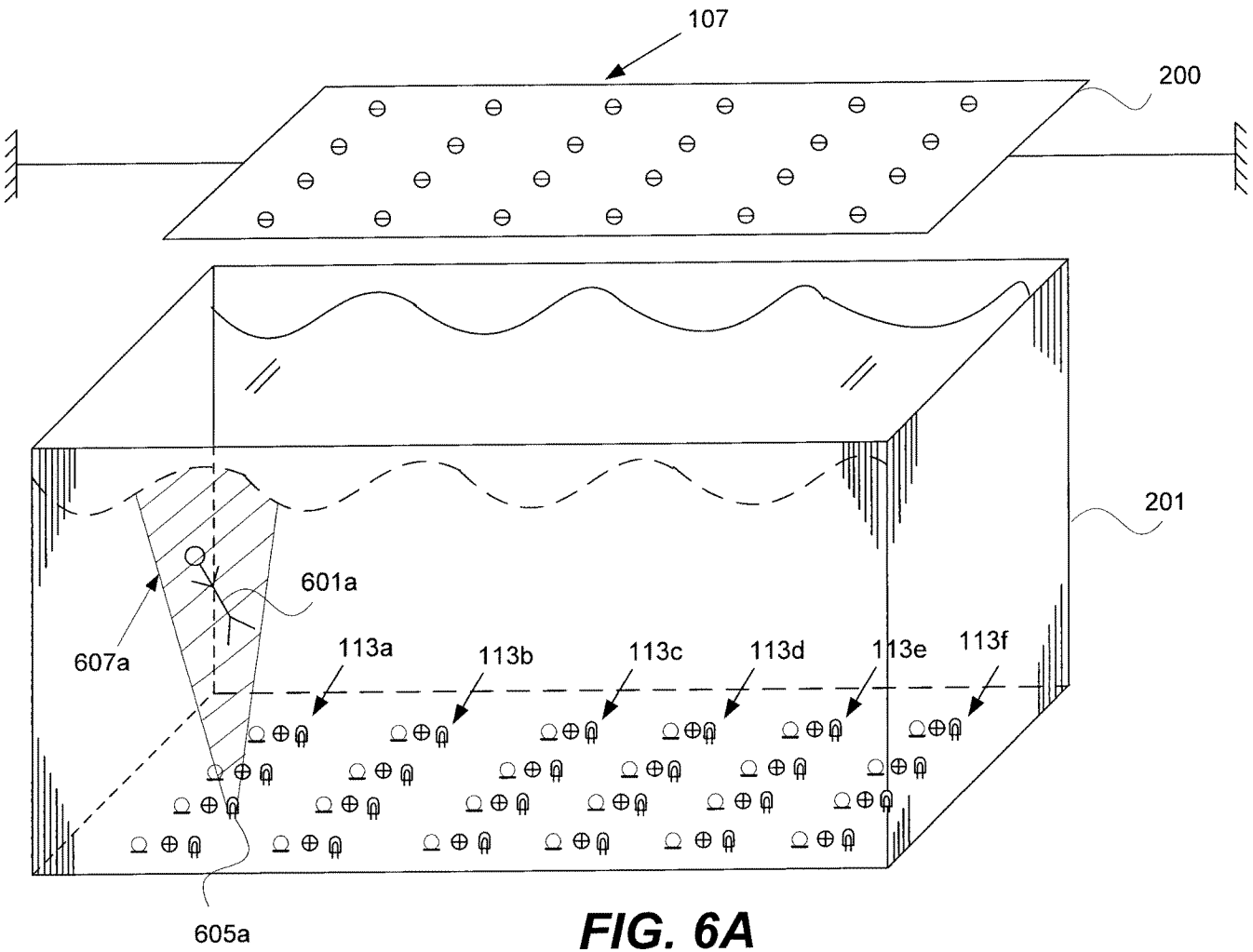
FIG. 6A illustrates a drowning location identification using a underwater light according to an exemplary embodiment of present disclosure.
Figure 6B:
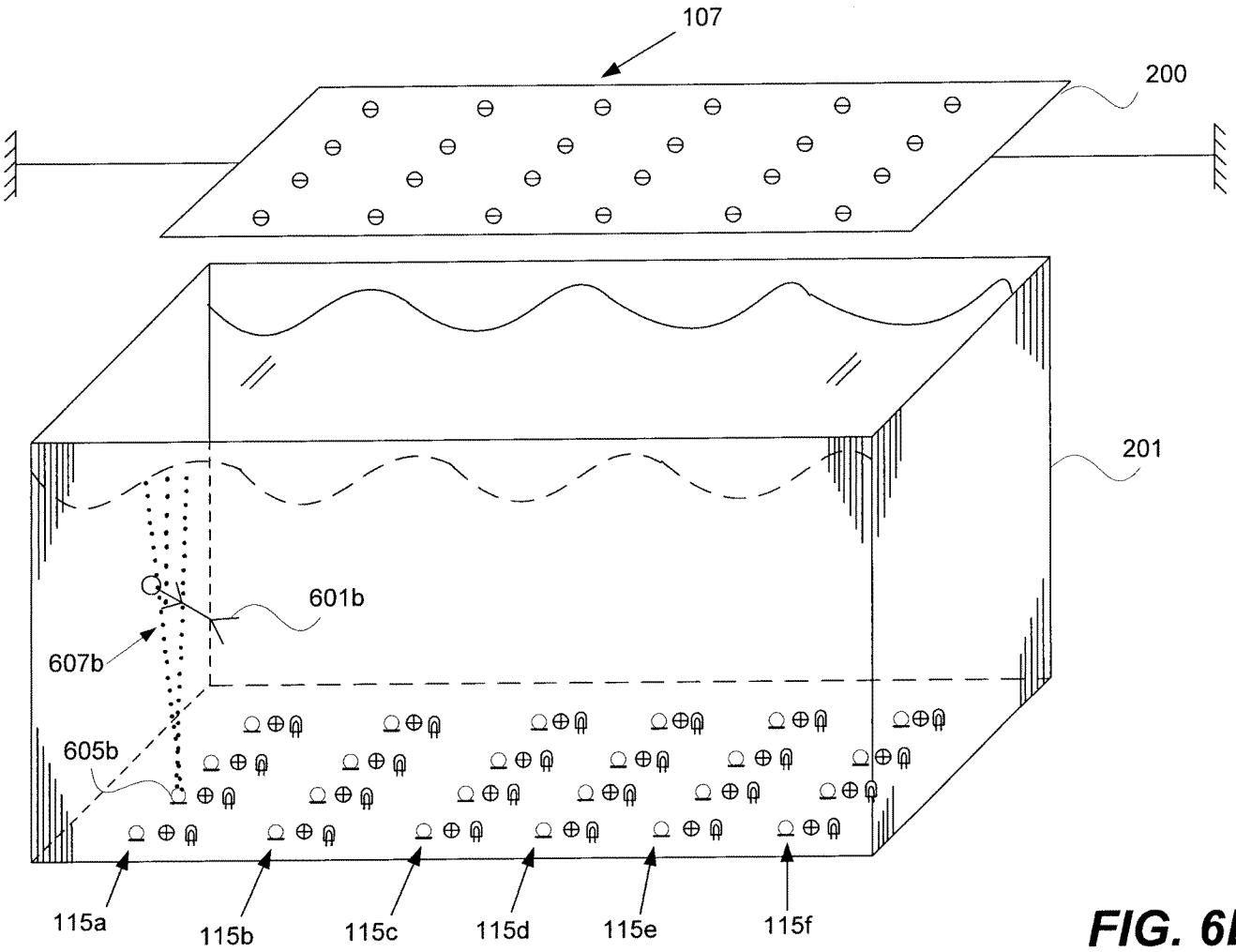
FIG. 6B illustrates a drowning location identification using a stream of air bubble according to an exemplary embodiment of present disclosure.

FIGS. 6A and 6B illustrate position identification of a drowning swimmer. FIG. 6A illustrates an array of light 113 used to identify the location of the swimmer in the pool. The array of light includes a set of light bulbs 113*a*-113*f* arranged next to the underwater array of sensors 105. A particular light bulb is activated in step 411 of the drowning detection process explained with reference to FIG. 4. Referring back to FIG. 1, the alarm controller 111 activates a particular light bulb. The activation of a particular light bulb occurs based on the location signals from depth transmitters S5 and S10 (see FIG. 2A) sent to the underwater and overhead array of sensors 105 and 107 respectively. For example, if a swimmer

601*a* is drowning on the left side of the pool, the light bulb 605*a* is activated from a set of light bulbs 113*a*. The light is projected upwards towards the pool surface that creates a light region 607*a* visible from the top of the pool thus identifying the location of the swimmer 601*a* and focusing the rescue operation on the drowning location.

Figure 7:
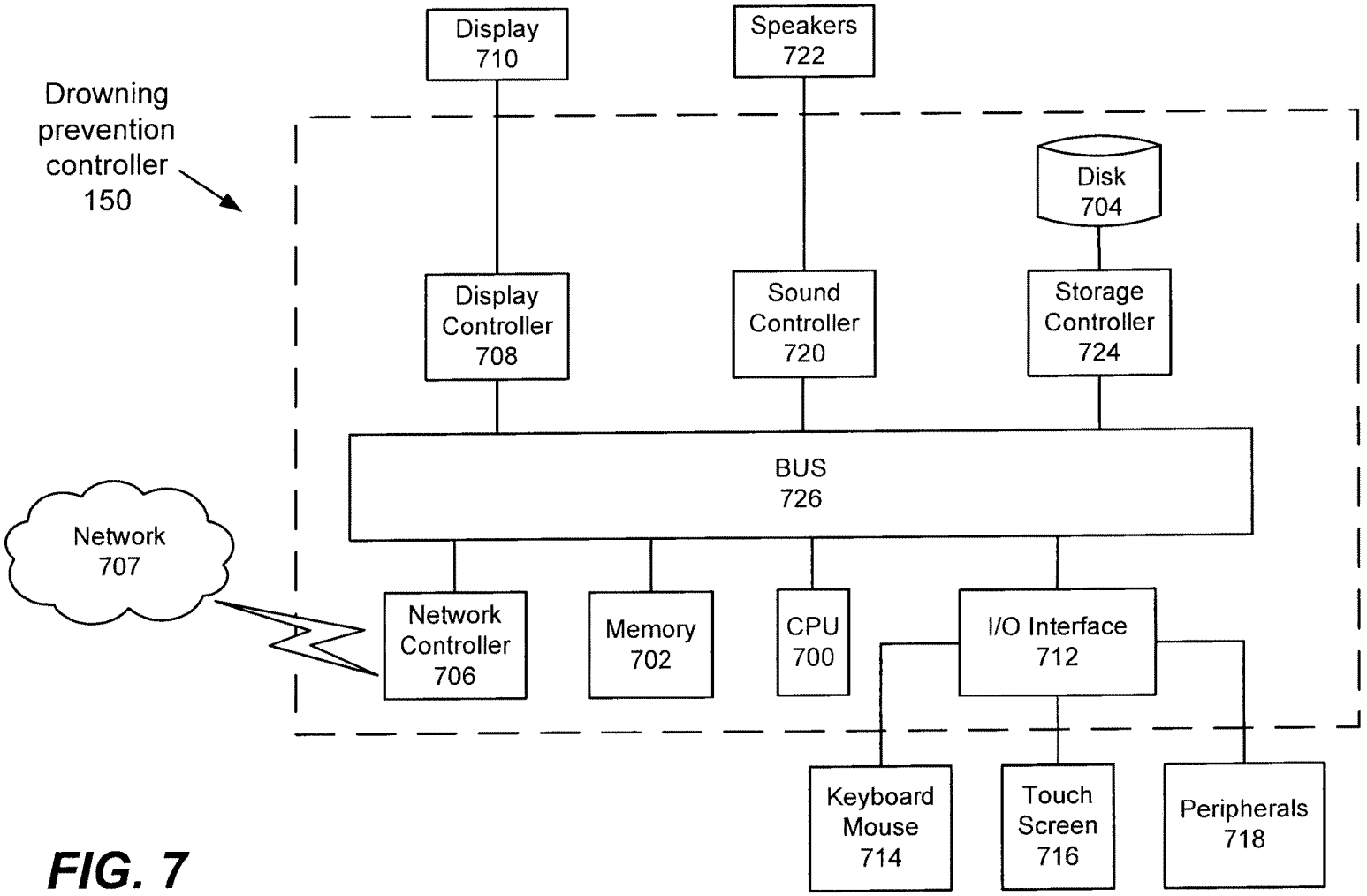
FIG. 7 is a hardware block diagram for implementing the drowning detection and the location detection process according to an embodiment of present disclosure.

Similarly, FIG. 6B illustrates a stream of bubbles used to identify the location of the swimmer in the pool. The array of bubble generator includes a set of bubble generator 115*a*-115*f* arranged next to the underwater array of sensors 105. A particular bubble generator is activated in step 411 of the drowning detection process, explained with reference to FIG. 4. Referring back to FIG. 1, the alarm controller 111 activates a particular bubble generator. The activation of a particular bubble generator occurs based on the location signals from depth transmitters S5 and S10 (see FIG. 2A) sent to the underwater and overhead array of sensors 105 and 107 respectively. For example, if a swimmer 601*b* is drowning on the left side of the pool, the bubble generator 605*b* is activated from a set of bubble generators 115*a*. The bubbles are projected upwards towards the pool surface that creates an air bubble region 607*b* visible from the top of the pool thus identifying the location of the swimmer 601*b* and focusing the rescue operation on the drowning location A hardware description of the detection system according to exemplary embodiments is described with reference to FIG. 7. The drowning prevention controller 150 includes a CPU 700 which performs the processes described in FIGS. 3 and 4. The process data and instructions may be stored in memory 702 such as the database 507 of FIG. 5. These processes and instructions may also be stored on a storage medium disk 704 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computer aided design station communicates, such as a server or computer.

Further, the claimed advancements may be provided as a utility application, background daemon, or component of an operating system, or combination thereof, executing in conjunction with CPU 700 and an operating system such as Microsoft Windows 7, UNIX, Solaris, LINUX, Apple MAC-OS and other systems known to those skilled in the art.

CPU 700 may be a Xenon or Core processor from Intel of America or an Opteron processor from AMD of America, or may be other processor types that would be recognized by one of ordinary skill in the art. Alternatively, the CPU 700 may be implemented on an FPGA, ASIC, PLD or using discrete logic circuits, as one of ordinary skill in the art would recognize. Further, CPU 700 may be implemented as multiple processors cooperatively working in parallel to perform the instructions of the inventive processes described above.

The drowning preservation controller 150 also includes a network controller 706, such as an Intel Ethernet PRO network interface card from Intel Corporation of America, for interfacing with a wireless network 707. The swimming activity data from the swimming aides 100 and 101, the underwater array of sensors 105 and overhead array of sensors 107 can be transmitted to a wireless device such as a smart phone or a tablet via the wireless network 707. As can be appreciated, the wireless network 707 can be a public network, such as the Internet, or a private network such as an LAN or WAN network, or any combination thereof and can also include PSTN or ISDN sub-networks. The wireless network 707 can also be wired, such as an Ethernet network, or can be wireless such as a cellular network including EDGE, 3G and 4G wireless cellular systems. The wireless network can also be WiFi, Bluetooth, or any other wireless form of communication that is known.

The drowning preservation controller 150, further includes a display controller 708, such as a NVIDIA GeForce GTX or Quadro graphics adaptor from NVIDIA Corporation of America for interfacing with display 710, such as a Hewlett Packard HPL2445w LCD monitor. A general purpose I/O interface 712 interfaces with a keyboard and/or mouse 714 as well as a touch screen panel 716 on or separate from display 710. FIG. 5 illustrates sample display monitors 503*a* and 503*b*. General purpose I/O interface also connects to a variety of peripherals 718 including printers and scanners, such as an OfficeJet or DeskJet from Hewlett Packard.

A sound controller 720 is also provided in the drowning preservation controller 150, such as Sound Blaster X-Fi Titanium from Creative, to interface with speakers/microphone 722 thereby providing sounds and/or music. The speakers/microphone 722 can also be used to accept dictated words as commands for controlling the drowning preservation controller 150 or for providing location and/or property information with respect to the target property.

The general purpose storage controller 724 connects the storage medium disk 704 with communication bus 726, which may be an ISA, EISA, VESA, PCI, or similar, for interconnecting all of the components of the drowning preservation controller 150. A description of the general features and functionality of the display 710, keyboard and/or mouse 714, as well as the display controller 708, storage controller 724, network controller 706, sound controller 720, and general purpose I/O interface 712 is omitted herein for brevity as these features are known.

Also, it should be understood that this technology when embodied is not limited to the above-described embodiments and that various modifications, variations and alternatives may be made of this technology so far as they are within the spirit and scope thereof. For example, this technology may be structured for cloud computing whereby a single function is shared and processed in collaboration among a plurality of apparatuses via a network.

What is claimed is:

1. A system for drowning prevention in a swimming pool comprising:

a wearable swimming aide with a plurality of wireless sensors including an underwater depth transmitter, a heart rate sensor, a motion sensor and a blood oxygen sensor;

an underwater array of sensors configured to receive signals from the underwater depth transmitter;

an overhead array of sensors fixed on a panel above the water in the swimming pool and configured to receive the signals from the underwater depth transmitter;

a drowning prevention controller configured to receive signals from the wearable swimming aide comprising data from the underwater depth transmitter, the heart rate sensor and the blood oxygen sensor of the wearable swimming aide, signals from the underwater array of sensors, and signals from the overhead array of sensors; and an alarm system including an underwater array of light sources and an array of underwater bubble generators activated by the drowning prevention controller in response to the drowning prevention controller determining a drowning event occurring for a wearer of the wearable swimming aide.

2. The system for drowning prevention according to claim 1, wherein the wearable swimming aide is detachably attachable to an ann and/or a leg of the wearer.

3. The system for drowning prevention according to claim 1, wherein the underwater array of sensors includes at least one of an acoustic detector,
a laser detector,
an infra-red detector, and
an optical detector.

4. The system for drowning prevention according to claim 1, wherein the overhead array of sensors includes at least one of
an acoustic detector,
a laser detector,
an infra-red detector, or
an optical detector.

5. The system for drowning prevention according to claim 1, wherein the drowning prevention controller determines the drowning event based on respective inputs from the heart rate sensor and the blood oxygen sensor.

6. The system for drowning prevention according to claim 5, wherein the drowning event is determined based on at least one of a heart rate threshold limit,
a blood oxygen level threshold limit,
a maximum swimming distance limit, and
a maximum swimming time limit.

7. The system for drowning prevention according to claim 6, wherein the heart rate threshold limit and the blood oxygen level threshold limit is set based on an age, a swimming experience, a physical condition, and a medical condition of the wearer of the wearable swimming aide.

8. The system for drowning prevention according to claim 1, wherein the drowning prevention controller determines a location of the wearer based on inputs from at least one of the underwater array of sensors, and the overhead array of sensors.

9. The system for drowning prevention according to claim 8, wherein the location of the swimmer the wearer is identifiable by at least one of the underwater array of light sources and the array of underwater bubble generators activated by the drowning prevention controller.

* * * * *